US011377983B2

(12) United States Patent
Lawes et al.

(10) Patent No.: US 11,377,983 B2
(45) Date of Patent: Jul. 5, 2022

(54) ROTARY VALVE INTERNAL COMBUSTION ENGINE

(71) Applicants: RCV ENGINES LIMITED, Wimborne (GB); KAAZ CORPORATION, Okayama (JP)

(72) Inventors: Keith Lawes, Wimborne (GB); Brian Mason, Wimborne (GB)

(73) Assignees: RCV ENGINES LIMITED, Wimborne (GB); KAAZ CORPORATION, Okayama (JP)

( * ) Notice: Subject to any disclaimer, the term of this patent is extended or adjusted under 35 U.S.C. 154(b) by 0 days.

(21) Appl. No.: 17/272,800

(22) PCT Filed: Sep. 4, 2019

(86) PCT No.: PCT/EP2019/073559
§ 371 (c)(1),
(2) Date: Mar. 2, 2021

(87) PCT Pub. No.: WO2020/049032
PCT Pub. Date: Mar. 12, 2020

(65) Prior Publication Data

US 2021/0285346 A1 Sep. 16, 2021

(30) Foreign Application Priority Data

Sep. 6, 2018 (GB) ..... 1814496
Sep. 6, 2018 (GB) ..... 1814502
(Continued)

(51) Int. Cl.
*F01L 7/02* (2006.01)
*F01N 1/02* (2006.01)
(Continued)

(52) U.S. Cl.
CPC ..... *F01L 7/028* (2013.01); *F01N 1/02* (2013.01); *F02B 63/02* (2013.01); *F02M 35/0204* (2013.01); *F02M 35/10144* (2013.01)

(58) Field of Classification Search
CPC ..... F01L 7/028; F01N 1/02; F01N 2590/06; F01N 1/00; F01N 13/08; F02B 63/02;
(Continued)

(56) References Cited

U.S. PATENT DOCUMENTS 4,311,119 A * 1/1982 Menzies ..... F01L 7/028 123/190.14
5,908,016 A 6/1999 Northam et al.

FOREIGN PATENT DOCUMENTS

AT 184777 B 2/1956
DE 2643242 A1 3/1978
(Continued)

OTHER PUBLICATIONS

International Search Report dated Nov. 26, 2019, for International Patent Application No. PCT/EP2019/073559.

*Primary Examiner* — Jacob M Amick
*Assistant Examiner* — Charles J Brauch
(74) *Attorney, Agent, or Firm* — Karceski IP Law, PLLC

(57) ABSTRACT

A spark ignition rotary valve internal combustion engine includes a combustion chamber being defined in part by the piston and the combustion end of the cylinder, a valve housing fixed at an outer portion of the combustion end of the cylinder and defining a bore, and a rotary valve rotatable about a rotary valve axis in the bore in the valve housing. The rotary valve has a hollow valve body subjected to combustion gases throughout the combustion process. The rotary valve also has, in a wall part thereof, a port giving, during rotation of the valve, fluid communication successively to and from the combustion chamber via inlet and exhaust ports in the valve housing. The inlet and exhaust
(Continued)

ports are angularly offset with respect to a radial line from the center of the engine cylinder.

12 Claims, 13 Drawing Sheets

(30) Foreign Application Priority Data

| | | |
|---|---|---|
| Sep. 6, 2018 | (GB) | 1814508 |
| Sep. 6, 2018 | (GB) | 1814512 |
| Sep. 6, 2018 | (GB) | 1814514 |
| Sep. 6, 2018 | (GB) | 1814530 |
| Jan. 17, 2019 | (GB) | 1900656 |

(51) Int. Cl.
*F02B 63/02* (2006.01)
*F02M 35/02* (2006.01)
*F02M 35/10* (2006.01)

(58) Field of Classification Search
CPC ..... F02M 35/0204; F02M 35/10144; F02F 1/242; F02F 1/42
See application file for complete search history.

(56) References Cited

FOREIGN PATENT DOCUMENTS

| | | | | |
|---|---|---|---|---|
| GB | 2467947 A | * | 8/2010 | ..... F01L 7/028 |
| GB | 2467947 A | | 8/2010 | |
| WO | 0227165 A1 | | 4/2002 | |

* cited by examiner

ROTARY VALVE INTERNAL COMBUSTION ENGINE

CROSS-REFERENCE TO RELATED APPLICATIONS

This is a National Stage Entry into the United States Patent and Trademark Office from International Patent Application No. PCT/EP2019/073559, filed on Sep. 4, 2019, which relies upon and claims priority to the following patent applications: (1) United Kingdom Patent Application No. GB 1814496.4 filed on Sep. 6, 2018; (2) United Kingdom Patent Application No. GB 1814502.9 filed on Sep. 6, 2018; (3) United Kingdom Patent Application No. GB 1814508.6 filed on Sep. 6, 2018; (4) United Kingdom Patent Application No. GB 1814512.8 filed on Sep. 6, 2018; (5) United Kingdom Patent Application No. GB 1814514.4 filed on Sep. 6, 2018; (6) United Kingdom Patent Application No. GB 1814530.0 filed on Sep. 6, 2018; and (7) United Kingdom Patent Application No. GB 1900656.8 filed on Jan. 17, 2019, the entire contents of all of which are incorporated herein by reference.

FIELD OF THE INVENTION

The present invention relates to a rotary valve internal combustion engine, particularly but not exclusively, for a manually held machine such as a horticultural grass trimmer or hedge trimmer, in which the control of the intake and exhaust gases of combustion is achieved by means of a rotary valve.

DESCRIPTION OF THE RELATED ART

A rotary valve internal combustion engine comprising: a piston connected to a crankshaft and that reciprocates in a cylinder, the cylinder having a combustion end, a combustion chamber being defined in part by the piston and the combustion end of the cylinder, a valve housing fixed at an outer portion of the combustion end of the cylinder and defining a bore and a rotary valve rotatable about a rotary valve axis in the bore in the valve housing, the rotary valve having a hollow valve body having an interior volume forming a part of the combustion chamber, wherein the interior volume of the hollow valve body is subjected to combustion gases throughout the combustion process, and further having in a wall part thereof a port giving, during rotation of the valve, fluid communication successively to and from the combustion chamber via inlet and exhaust ports in the valve housing.

SUMMARY OF THE INVENTION

The present invention seeks to provide such an engine suitable for use with a horticultural machine designed to be held and operated manually by an operator. The term horticultural machine is intended to include hand-held machines for use in horticulture, gardens and forestry for such purposes as grass trimmers, hedge trimmers, brush cutters, clearing saws, shredders, blowers vacuum collectors, mist blowers, and chainsaws.

According to the present invention there is provided a rotary valve internal combustion engine comprising: a piston connected to a crankshaft and that reciprocates in a cylinder, the cylinder having a combustion end, a combustion chamber being defined in part by the piston and the combustion end of the cylinder, a valve housing fixed at an outer portion of the combustion end of the cylinder and defining a bore and a rotary valve rotatable about a rotary valve axis in the bore in the valve housing, the rotary valve having a hollow valve body having an interior volume forming a part of the combustion chamber, wherein the interior volume of the hollow valve body is subjected to combustion gases throughout the combustion process, and further having in a wall part thereof a port giving, during rotation of the valve, fluid communication successively to and from the combustion chamber via inlet and exhaust ports in the valve housing, the engine having a carburetor for controlling the air/fuel mix into the engine and an exhaust muffler for the exhaust gases, wherein the port layout is arranged to position the exhaust muffler and carburetor on opposite sides of the engine, the port angles being arranged such that the main body of the carburetor and main body of the muffler are substantially parallel to the centerline of the engine, wherein when the engine is at top dead center, the valve port is angled a predetermined number of degrees from the crankshaft axis said angular offset reducing the radial offset of the inlet port that is required to achieve a mounting flange for the carburetor that is substantially parallel to the centerline of the engine, the centerline of the inlet port is offset towards the operator a predetermined number of degrees from a radial line from the cylinder axis, said angular offset allowing the mounting flange for the carburetor to be substantially parallel to the centerline of the engine, and the centerline of the exhaust port is offset a predetermined number of degrees from a radial line from the cylinder axis, said angular offset allowing the main body of the muffler to be substantially parallel to the centerline of the engine using an angled mounting flange.

BRIEF DESCRIPTION OF THE DRAWINGS

Preferred embodiments of the present invention will now be described by way of example with reference to the accompanying drawings, in which.

DETAILED DESCRIPTION OF EMBODIMENT(S) OF THE INVENTION

Figure 1:
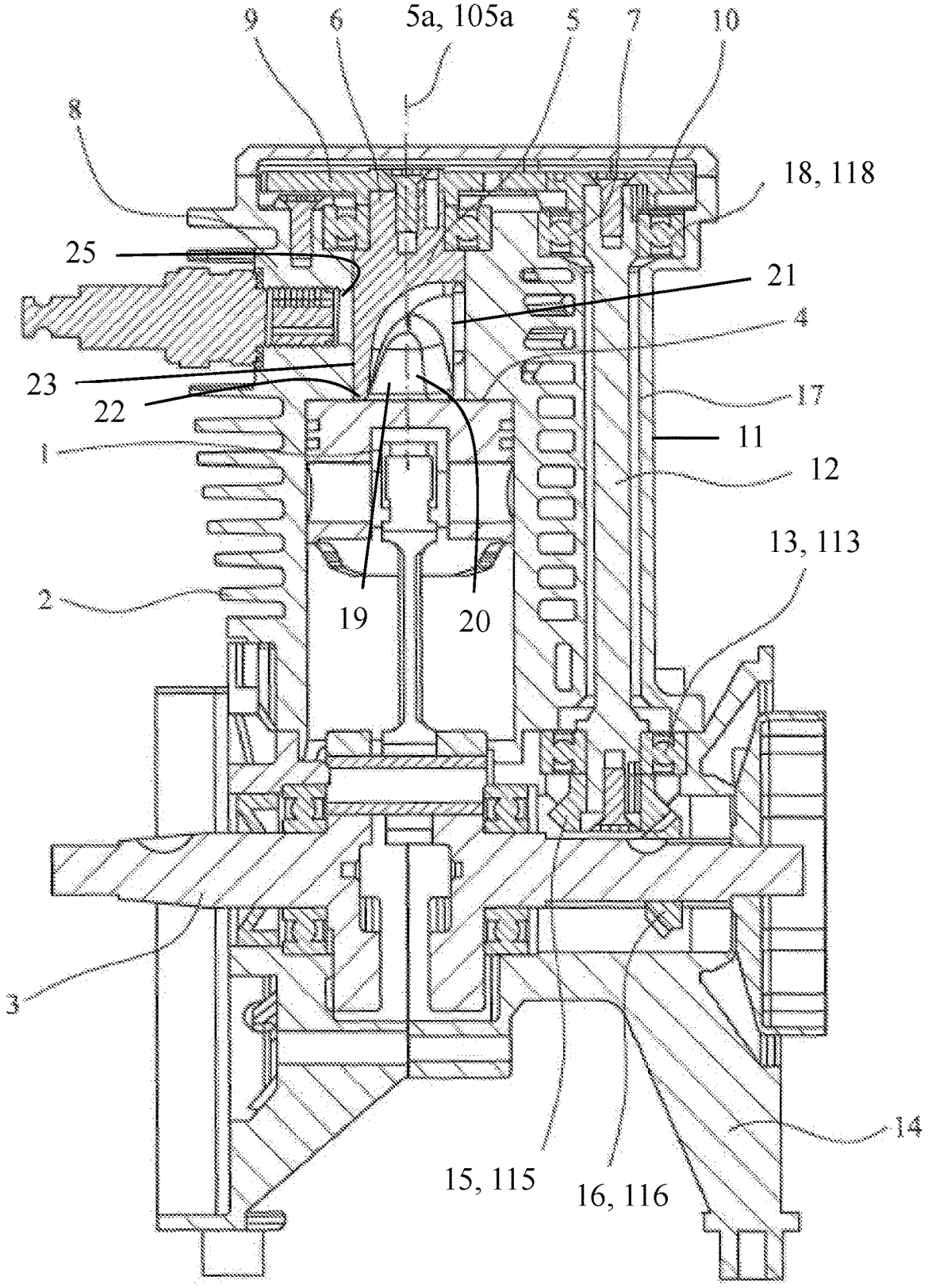
FIG. 1 shows a cross-sectional view of a single cylinder air cooled spark ignition rotary valve internal combustion engine.

Referring now to FIG. 1, there is shown a single cylinder air cooled engine. The engine has a cylinder housing containing the cylinder 2. A piston 1 is connected in the conventional manner to a crankshaft 3 mounted for rotation in a crankcase 14 for reciprocation in the cylinder 2. The upper part of the cylinder 2 is closed by a combustion chamber 4 in a combustion chamber housing. The combustion chamber housing has an inlet port 27 for the flow of inlet air/fuel mix into the combustion chamber and an exhaust port 28 for venting the exhaust gas out of the combustion chamber 4, the gas flows being controlled by a rotary valve 5. In this embodiment, the valve 5 is rotatable in a valve housing 8 in the combustion chamber housing about an axis 5*a* which is co-axial with the axis of the cylinder 2. In other embodiments, the axis of rotation of the valve body is offset from the axis 5*a* of the cylinder 2.

At its end remote from the combustion chamber 4, the rotary valve 5 has a concentric drive shaft 6 carrying a single race ball bearing 7 which rotatably supports the valve 5 in the valve housing 8. The valve driveshaft 6 is secured to a coaxial driven gear 9 which meshes with a drive gear 10 of a drive arrangement 11 through which the driven gear 9 and hence the rotary valve 5 is connected to the crankshaft 3. The drive arrangement 11 includes a drive shaft 12 which is located in a channel or tube 17 in the cylinder housing and mounted for rotation in an upper bearing 18 adjacent the drive gear 10 and a lower bearing 13 adjacent the crankshaft 3. The driveshaft 11 carries a bevel gear 15 which meshes with a corresponding bevel gear 16 secured on the crankshaft for rotation with the crankshaft 3. Thus, the rotation of the crankshaft 3 and hence the piston movement is coordinated with the rotation of the rotary valve 5 so that the engine operates on the conventional four stroke cycle. To achieve this, the diameter of the driven gear 9 is twice that of the drive gear 10 so that the rotary valve 5 rotates at half engine speed. The rotary valve 5 comprises a generally cylindrical rotary valve body 5 rotatable about a rotary valve axis 5*a* with a close sliding fit in the bore in the valve housing 8, the rotary valve 5 having a hollow valve body 19 having an interior volume 20 forming a part of the combustion chamber. The valve has a generally cylindrical body part comprising the valve body 19 itself which is slightly larger in diameter than the shaft 6, which forms a shoulder 14 against which the inner race of the ball bearing 7 is located. The valve body 19 extends into the combustion chamber and has in its interior volume 20 which forms part of the combustion chamber 4 and which is subject to combustion gases at all stages of the combustion process.

The shaft 6 part of the rotary valve 5 is only slightly smaller in diameter than the valve body 19 to provide the shoulder 14. The shaft is solid to provide a good path for conducting heat from the valve body 19 to the exterior.

The rotary valve body 19 has a port 21 which, during rotation of the valve, enables fluid communication successively to and from the interior volume of the valve and hence the combustion chamber via the inlet and exhaust ports in the valve housing. In this embodiment the port 21 is in the form of a recess formed in the lower peripheral edge 22 of the wall 23 of the valve body adjacent to the combustion chamber 4 the recess extending upwardly from this lower edge of the wall of the valve to form the port 21 in the side of the valve Ignition is provided by a spark plug secured into a plug bore 25 formed in the valve housing 8 and extending into the valve bore.

Figure 2:
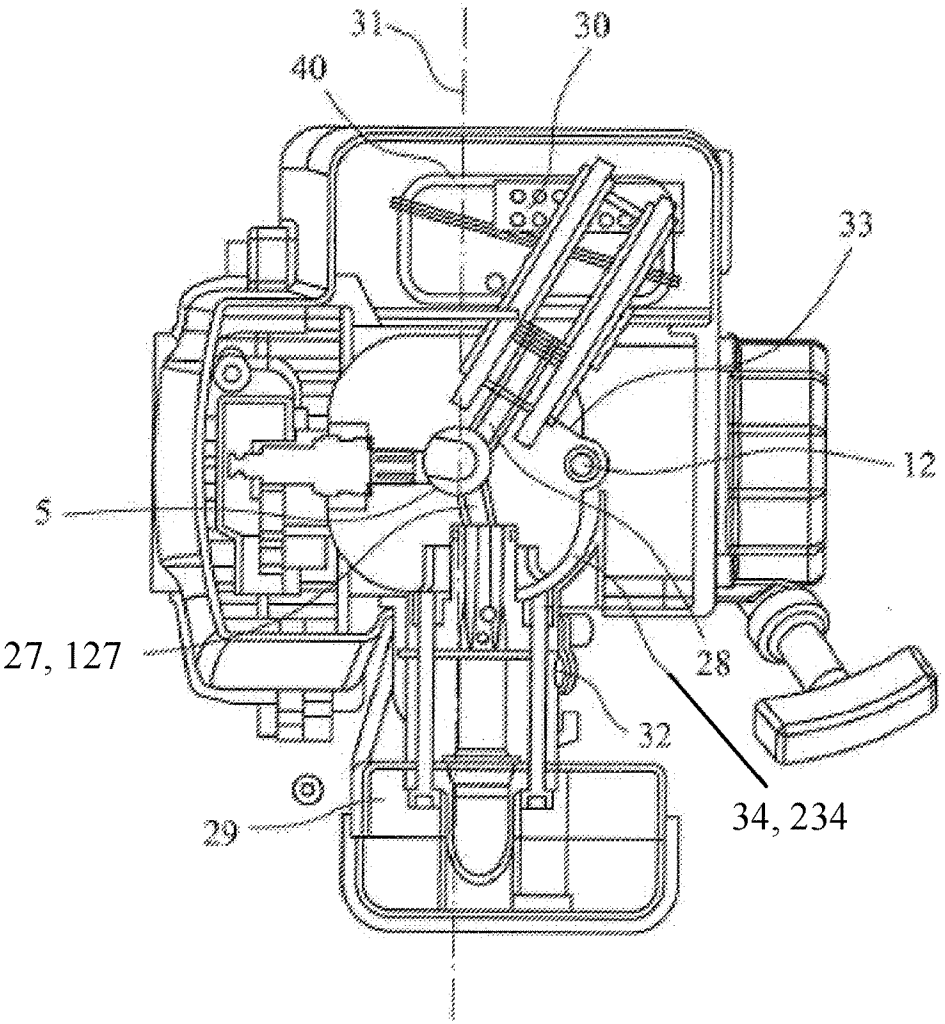
FIG. 2 shows a part-sectional plan view of an embodiment of the engine for use with a manually held and operated horticultural machine such as a strimmer or hedge trimmer.

Referring now to FIG. 2, there is shown a plan view of an engine intended for a horticultural machine such as a grass trimmer or a hedge trimmer which is manually held and operated by an operator where the engine is positioned to one side and/or behind the operator. In such machines, it is a requirement that the exhaust and exhaust muffler is located away from the operator and a carburetor for controlling the air/fuel mix through the inlet is located towards the operator. This is due to the heat of the exhaust and fact that the operator may be required to adjust the carburetor. A carburetor with airbox assembly 29 is attached to the inlet port 27, and an exhaust muffler 30 is connected to the exhaust port 28. Ideally, both the carburetor airbox assembly 29 and the exhaust muffler 30 should be substantially parallel to the centerline of the crankshaft the inlet and exhaust ports should be straight rather than curved to enable diecasting of the cylinder 2. Straight ports and exhaust muffler/carburetor airbox positions simplify manufacture, neaten the appearance of the engine and make the engine easier to package within a typical horticultural machine. However, in order to provide the correct valve timing of the engine, which is determined by the position of the inlet and exhaust openings in the valve housing, this will require both the inlet ports and exhaust ports to be angled away from their ideal angle which is aligned with a radius running from the cylinder axis.

Moreover, as any restriction in flow in the inlet port due to a non-radial port angle will have a greater effect on engine power than the equivalent restriction in the exhaust port, the ports are angled such that the inlet port is closer to the ideal radial angle than the exhaust port.

In this embodiment, the top dead center timing point is angled towards the inlet side from the centerline of the crankshaft by 10°, in other words when the piston is at top dead center the centerline of the valve port is pointing 10 degrees towards the side of the engine nearest the operator. This enables the inlet port opening within the valve housing to be moved round 10 degrees towards the operator. This enables the inlet port 27 to be closer to the ideal radial angle than the exhaust port. The inlet port 27 is then angled a further 11° from the radial axis of the cylinder axis with the result that the mounting flange of the carburetor airbox assembly 29 is substantially parallel to the centerline of the engine The centerline of the exhaust port 28 is offset 15° from the radial axis. The exhaust muffler has an angled flange 33 which mates with the exhaust port 28 so as to allow the main body of the exhaust muffler to be aligned substantially with the centerline 31 of the engine.

The exhaust muffler 13 is having a two-part shell construction of the muffler and a flange to mate with the angled exhaust port. This has the advantage of avoiding the use of a separate tube or pipe between the exhaust port and the muffler body.

As shown in up FIG. 2, the inlet side of the cylinder has a curved panel 34 which serves to guide cooling air around the rear of the cylinder to provide a cooling flow around the rear of the cylinder.

Figure 3:
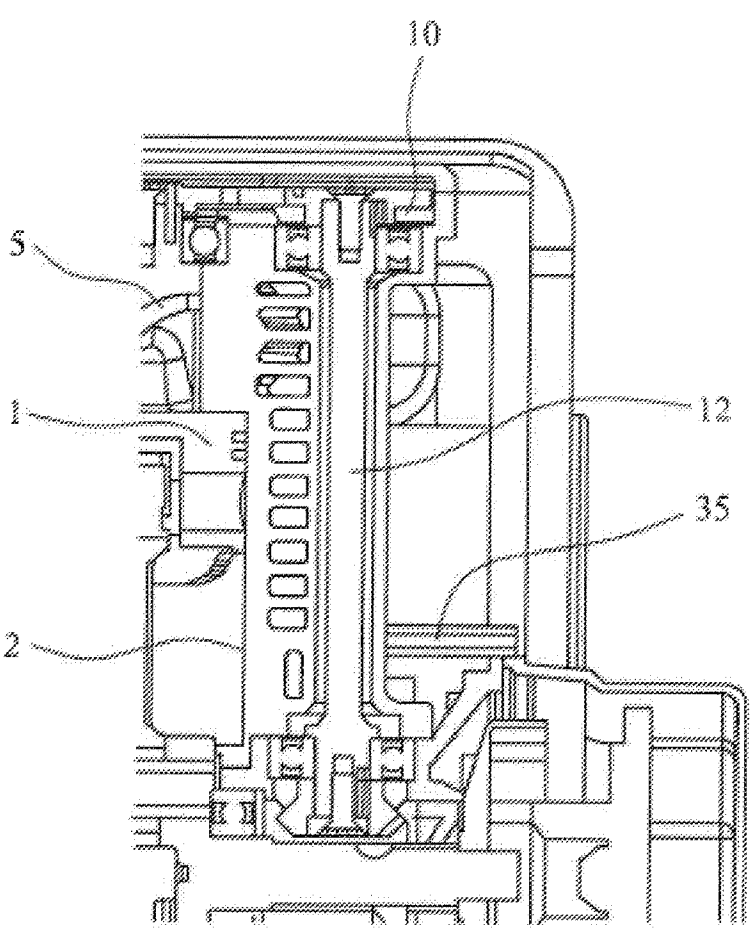
FIG. 3 shows a side view of part of the engine shown in FIG. 2.

A closure plate 35 at the rear of the engine, shown in FIG. 3, forms a lower face of the cooling air flow passage, which forces the cooling air to exit from the rear of cowl, rather than short circuiting down into the cooling air intake.

Figure 4:
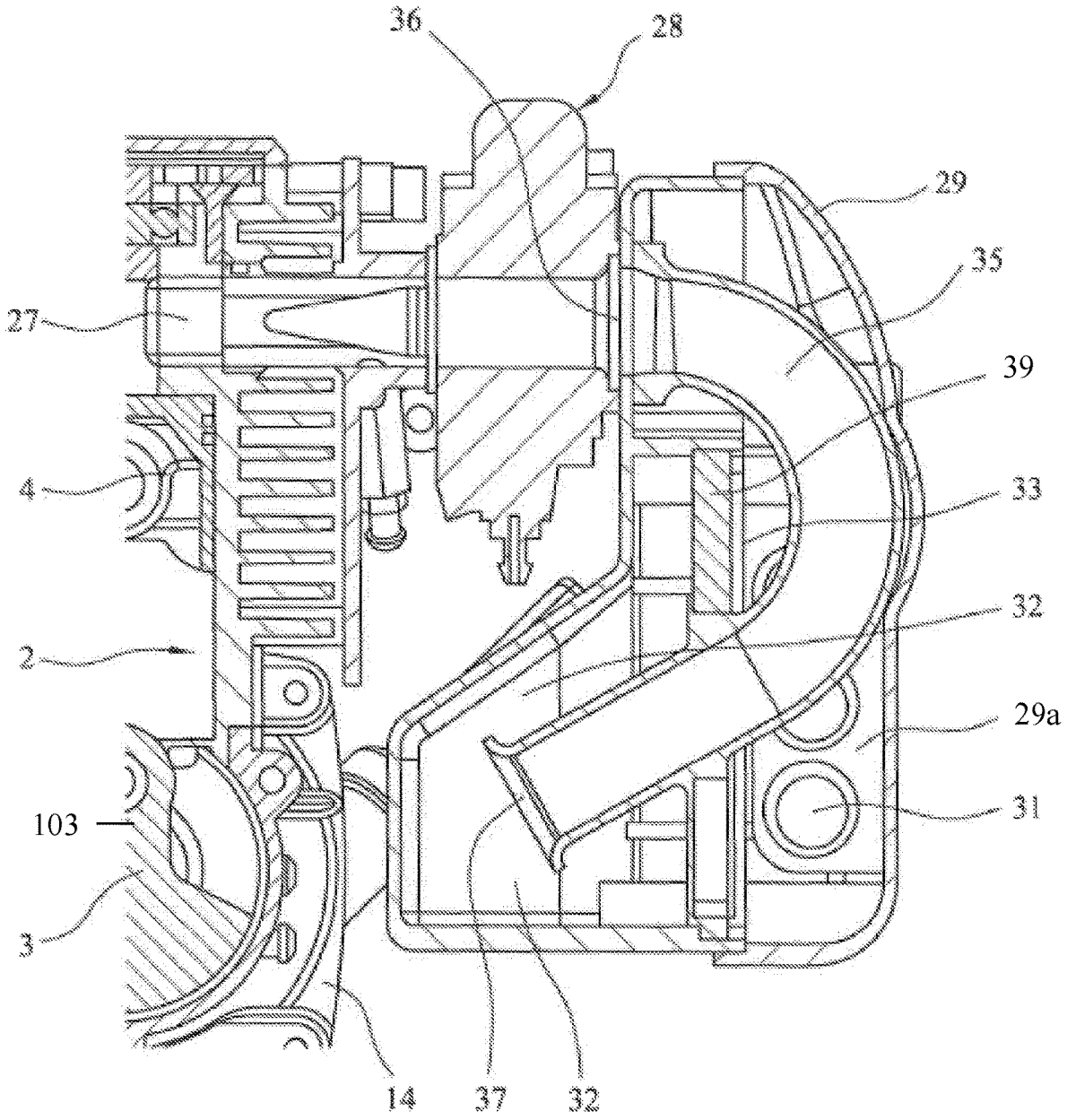
FIG. 4 there is shown a sectional view of part of the engine of FIG. 1 illustrating the air/fuel inlet tract.

Referring now to FIG. 4 there is shown a sectional view of part of the engine of FIG. 1 illustrating the air/fuel inlet tract. Part of the outer casing 29 of the engine comprises an air box 29*a*, also known as a plenum chamber, which is divided by a wall 33 into an unfiltered air volume into which ambient air enters through inlet passages 31, and a filtered air volume 32.

The dividing wall 33 contains a filter 39 through which air from the unfiltered side passes into the filtered air side volume 32. The inlet tract has a tuning pipe 35 secured to the carburetor. The tuning pipe 35 leads from the air inlet 36 of the carburetor 28 through a curved path passing through the unfiltered volume in the airbox, through the dividing wall and into the filtered air volume 32. In one form, the tuning pipe 35 passes through the filter itself. The inlet 37 to the tuning pipe 35 is located in the filtered volume 32 and is flared outwardly to improve the flow of air into the tuning pipe 35 and hence into the engine. The curved path maximizes the length of the tuning pipe which increases the efficiency of the engine without causing a significant change to the overall size of the engine.

Although shown as a simple curve, it will be appreciated that the tuning pipe may have a more complex shape and may follow a serpentine path.

Figure 5:
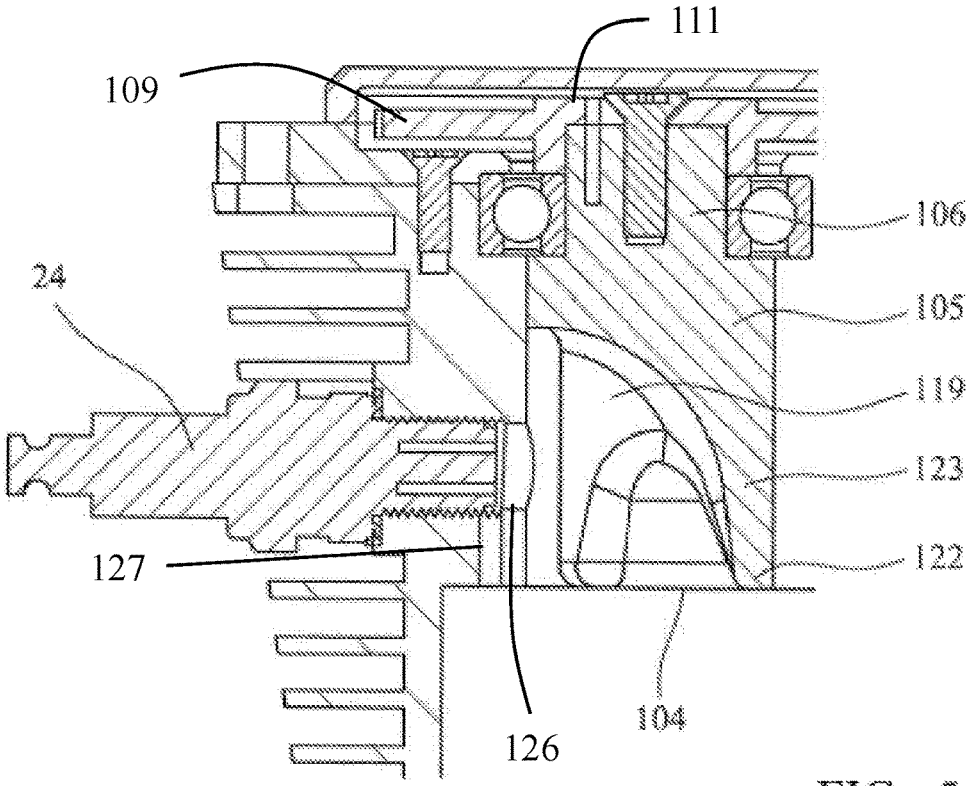
FIG. 5 shows a cross-sectional view of part of a single cylinder air cooled spark ignition rotary valve internal combustion engine.

Referring now to FIG. 5, there is shown a single cylinder air cooled engine. The engine has a cylinder housing containing the cylinder 102. A piston 101 is connected in the conventional manner to a crankshaft 103 mounted for rotation in a crankcase 114 for reciprocation in the cylinder 102. The upper part of the cylinder 102 is closed by a combustion chamber 104 in a combustion chamber housing. The flow of inlet air/fuel mix and exhaust gas into and out of the combustion chamber 104 is controlled by a rotary valve 105. In this embodiment, the valve 105 is rotatable in a valve housing 108 in the combustion chamber housing about an axis 105*a* which is co-axial with the axis of the cylinder 102. In other embodiments, the axis of rotation of the valve body is offset from the axis 105*a* of the cylinder 102.

At its end remote from the combustion chamber 104, the rotary valve 105 has a concentric drive shaft 106 carrying a single race ball bearing 107 which rotatably supports the valve 105 in the valve housing 108. The valve driveshaft 106 is secured to a coaxial driven gear 109 which meshes with a drive gear 110 of a drive arrangement 111 through which the driven gear 109 and hence the rotary valve 105 is connected to the crankshaft 103. The drive arrangement 111 includes a drive shaft 112 which is located in a channel or tube 117 in the cylinder housing and mounted for rotation in an upper bearing 118 adjacent the drive gear 110 and a lower bearing 113 adjacent the crankshaft 103. The driveshaft 112 carries a bevel gear 115 which meshes with a corresponding bevel gear 116 secured on the crankshaft for rotation with the crankshaft 103. Thus, the rotation of the crankshaft 103 and hence the piston movement is coordinated with the rotation of the rotary valve 105 so that the engine operates on the conventional four stroke cycle. To achieve this, the diameter of the driven gear 109 is twice that of the drive gear 110 so that the rotary valve 105 rotates at half engine speed.

Figure 6:
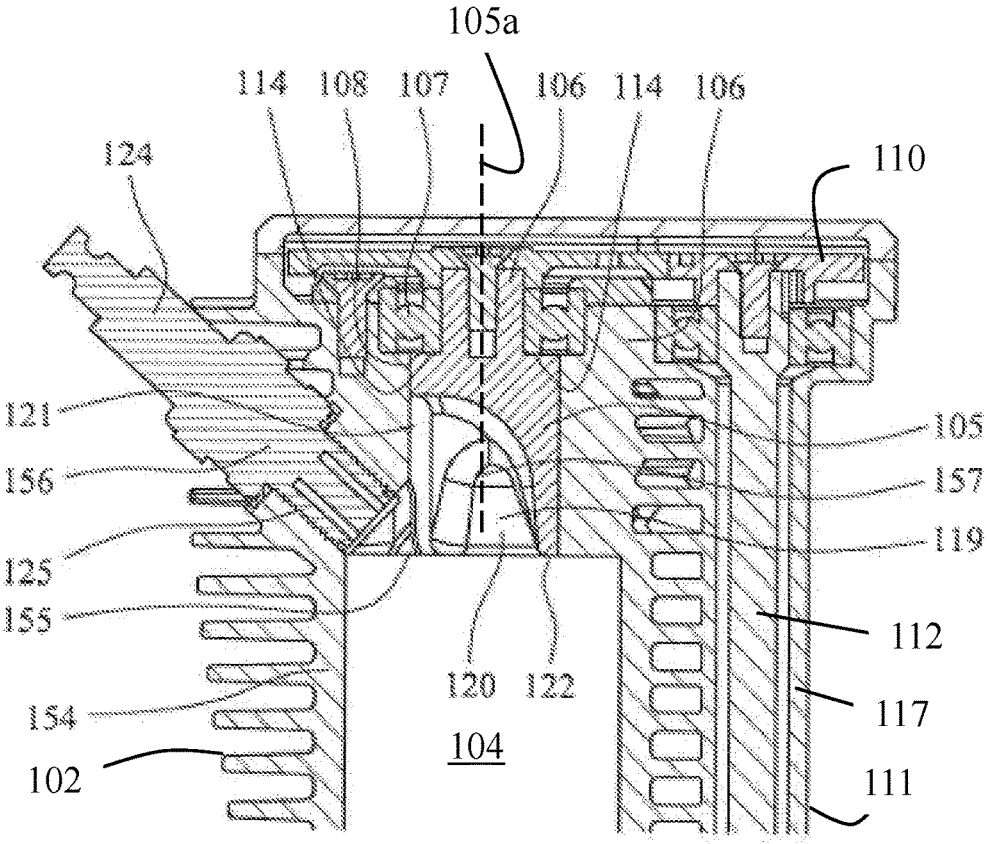
FIG. 6 is an enlarged schematic view of part of the rotary valve body and spark plug.

Referring now to FIG. 6 also, there is shown more detail of the rotary valve 105 which comprises a generally cylindrical rotary valve body 105 rotatable about a rotary valve axis 105*a* with a close sliding fit in the bore in the valve housing 108, the rotary valve 105 having a hollow valve body 119 having an interior volume 120 forming a part of the combustion chamber. The valve has a generally cylindrical body part comprising the valve body 119 itself which is slightly larger in diameter than the shaft 106, which forms a shoulder 114 against which the inner race of the ball bearing 107 is located. The valve body 119 extends into the combustion chamber and has in its interior a volume 120 which forms part of the combustion chamber 104 and which is subject to combustion gases at all stages of the combustion process. The valve body 119 is rotatable in a bore in a valve housing 108 with a close sliding fit. The valve 105 and the valve housing 108 are formed of aluminum.

The shaft 106 part of the rotary valve 105 is only slightly smaller in diameter than the valve body 119 to provide the shoulder 114. The shaft is solid to provide a good path for conducting heat from the valve body 119 to the exterior.

The rotary valve body 119 has a port 121 which, during rotation of the valve, enables fluid communication successively to and from the interior volume of the valve and hence the combustion chamber via inlet and exhaust ports in the valve housing. In this embodiment the port 121 is in the form of a recess formed in the lower peripheral edge 122 of the wall 123 of the valve body adjacent to the combustion chamber 104 the recess extending upwardly from this lower edge of the wall of the valve to form the port 121 in the side of the valve.

Ignition is provided by a spark plug 124 secured into a plug bore 125 formed in the valve housing 108 and extending into the valve bore. The axis of the plug bore 125 where it meets the valve body is axially below the centerline of the valve ports. In this way, the point of ignition is closer to the main mass of the incoming fuel mixture.

The plug bore is formed with a screw thread just long enough to secure the plug 124 in the plug bore 125, the remaining part of the plug bore 125 between the end of the screw thread supporting the plug and the opening of the plug bore 125 into the combustion chamber comprises a spark plug bore volume 126 the bore of which is smooth to improve the flow of the incoming fuel charge and to speed the passage of the flame front from the spark plug into the main volume of the combustion chamber 104.

The plug bore volume 126 is inevitably present since it is necessary to ensure that there is a gap between the body of the spark plug itself and the rotating valve. However, this does have the disadvantage in that it forms a pocket for exhaust gases after ignition which tends to delay the incoming charge/air mixture for the next cycle and also prevents the maximum possible amount of charge/air mix reaching the spark plug. To obviate this disadvantage a vent 127 is provided leading from the spark plug bore volume 126 to the main volume of the combustion chamber so that the spark plug bore volume 126 is in fluid communication with the main volume of the combustion chamber 104. This vents the volume 126 prior to the next input of fresh fuel charge for the next cycle. As shown in FIG. 6, the vent 127 comprises a bore in the valve housing leading from the volume 126 into the combustion chamber 104. In alternative constructions, the vent may be formed by a channel or groove formed in the valve housing 108.

The embodiment of FIGS. 5 and 6 shows a rotary valve internal combustion engine comprising: a piston connected to a crankshaft and that reciprocates reciprocatable in a cylinder, the cylinder having a combustion end, a combustion chamber being defined in part by the piston and the combustion end of the cylinder, a valve housing fixed at an outer portion of the combustion end of the cylinder and defining a bore and a rotary valve rotatable about a rotary valve axis in the bore in the valve housing, the rotary valve having a hollow valve body having an interior volume forming a part of the combustion chamber, wherein the interior volume of the hollow valve body is subjected to combustion gases throughout the combustion process, and further having in a wall part thereof a port giving, during rotation of the valve, fluid communication successively to and from the combustion chamber via inlet and exhaust ports in the valve housing, wherein the engine is a spark ignition engine, the spark plug being screwed into a plug bore in the valve housing adjacent the valve body, a spark plug bore volume being formed in the plug bore between the plug and the valve body, and a vent is located in the valve housing between the spark plug volume and the main cylinder volume, to vent combustion gases in the spark plug volume into the main cylinder volume.

In a preferred form, the vent comprises a bleed bore in the valve housing or a channel or groove in the valve housing.

Figure 7:
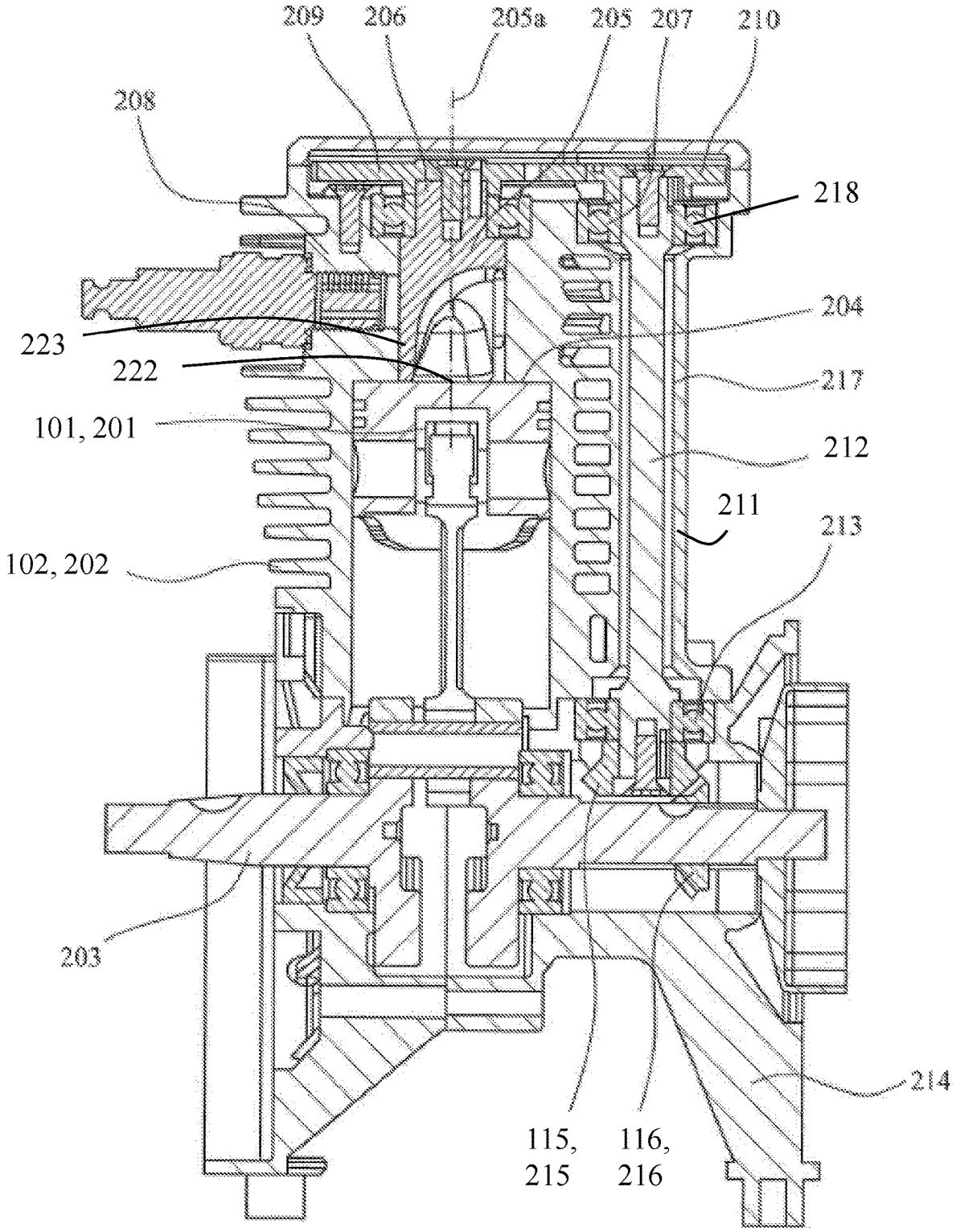
FIG. 7 shows a cross-sectional view of a single cylinder air cooled rotary valve internal combustion engine.

Referring now to FIG. 7, there is shown a single cylinder air cooled engine. The engine has a cylinder housing containing the cylinder 202. A piston 201 is connected in the conventional manner to a crankshaft 203 mounted for rotation in a crankcase 214 for reciprocation in the cylinder 202. The upper part of the cylinder 202 is closed by a combustion chamber 204 in a combustion chamber housing. The flow of inlet air/fuel mix and exhaust gas into and out of the combustion chamber 204 is controlled by a rotary valve 205. In this embodiment, the valve 205 is rotatable in a valve housing 208 in the combustion chamber housing about an axis 205*a* which is co-axial with the axis of the cylinder 202. In other embodiments, the axis of rotation of the valve body is offset from the axis 205*a* of the cylinder 202.

At its end remote from the combustion chamber 204, the rotary valve 205 has a concentric drive shaft 206 carrying a single race ball bearing 207 which rotatably supports the valve 205 in the valve housing 208. The valve driveshaft 206 is secured to a coaxial driven gear 209 which meshes with a drive gear 210 of a drive arrangement 211 through which the driven gear 209 and hence the rotary valve 205 is connected to the crankshaft 203. The drive arrangement 211 includes a drive shaft 212 which is located in a channel or tube 217 in the cylinder housing and mounted for rotation in an upper bearing 218 adjacent the drive gear 210 and a lower bearing 213 adjacent the crankshaft 203. The channel or tube 217 is cast into the cylinder housing. The channel or tube 217 is formed integrally with the cylinder housing, which may be formed by a casting process. The driveshaft 211 carries a bevel gear 215 which meshes with a corresponding bevel gear 216 secured on the crankshaft for rotation with the crankshaft 203. Thus, the rotation of the crankshaft 203 and hence the piston movement is coordinated with the rotation of the rotary valve 205 so that the engine operates on the conventional four stroke cycle. To achieve this, the diameter of the driven gear 209 is twice that of the drive gear 210 so that the rotary valve 205 rotates at half engine speed.

Figure 8:
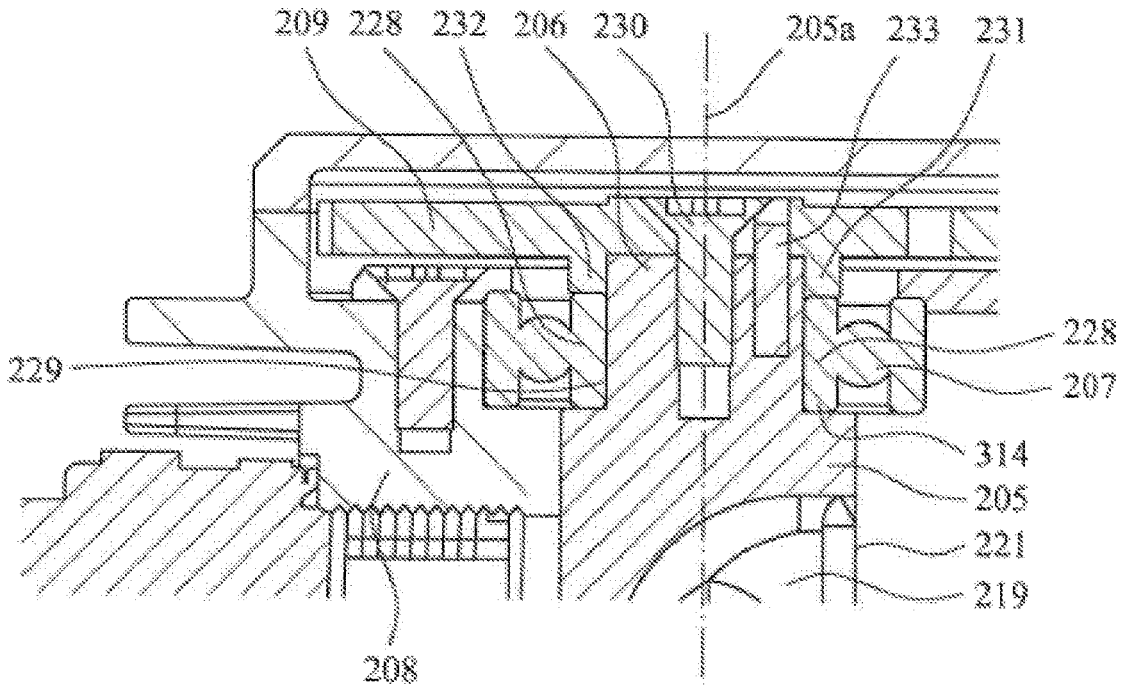
FIG. 8 is an enlarged schematic view of part of the rotary valve body and drive gear.

Referring now to FIG. 8 also, there is shown more detail of the rotary valve 205 which comprises a generally cylindrical rotary valve body 205 rotatable about a rotary valve axis 205*a* with a close sliding fit in the bore in the valve housing 208, the rotary valve 205 having a hollow valve body having an interior volume 219 forming a part of the combustion chamber. The valve has a generally cylindrical body part comprising the valve body 219 itself which is slightly larger in diameter than the shaft 206, which forms a shoulder 214 against which the inner race 228 of the ball bearing 207 is located. The valve body 219 extends into the combustion chamber and has in its interior a volume 220 which forms part of the combustion chamber 204 and which is subject to combustion gases at all stages of the combustion process. The valve body 219 is rotatable in a bore in a valve housing 208 with a close sliding fit. The valve 205 and the valve housing 208 are formed of aluminum.

The shaft 206 part of the rotary valve 205 is only slightly smaller in diameter than the valve body 219 to provide the shoulder 214. The shaft is solid to provide a good path for conducting heat from the valve body 219 to the exterior.

The rotary valve body port 221, during rotation of the valve, enables fluid communication successively to and from the interior volume of the valve and hence the combustion chamber via inlet and exhaust ports in the valve housing. In this embodiment the port 221 is in the form of a recess formed in the lower peripheral edge 222 of the wall 223 of the valve body adjacent to the combustion chamber 204 the recess extending upwardly from this lower edge of the wall of the valve to form the port 221 in the side of the valve.

Figure 9:
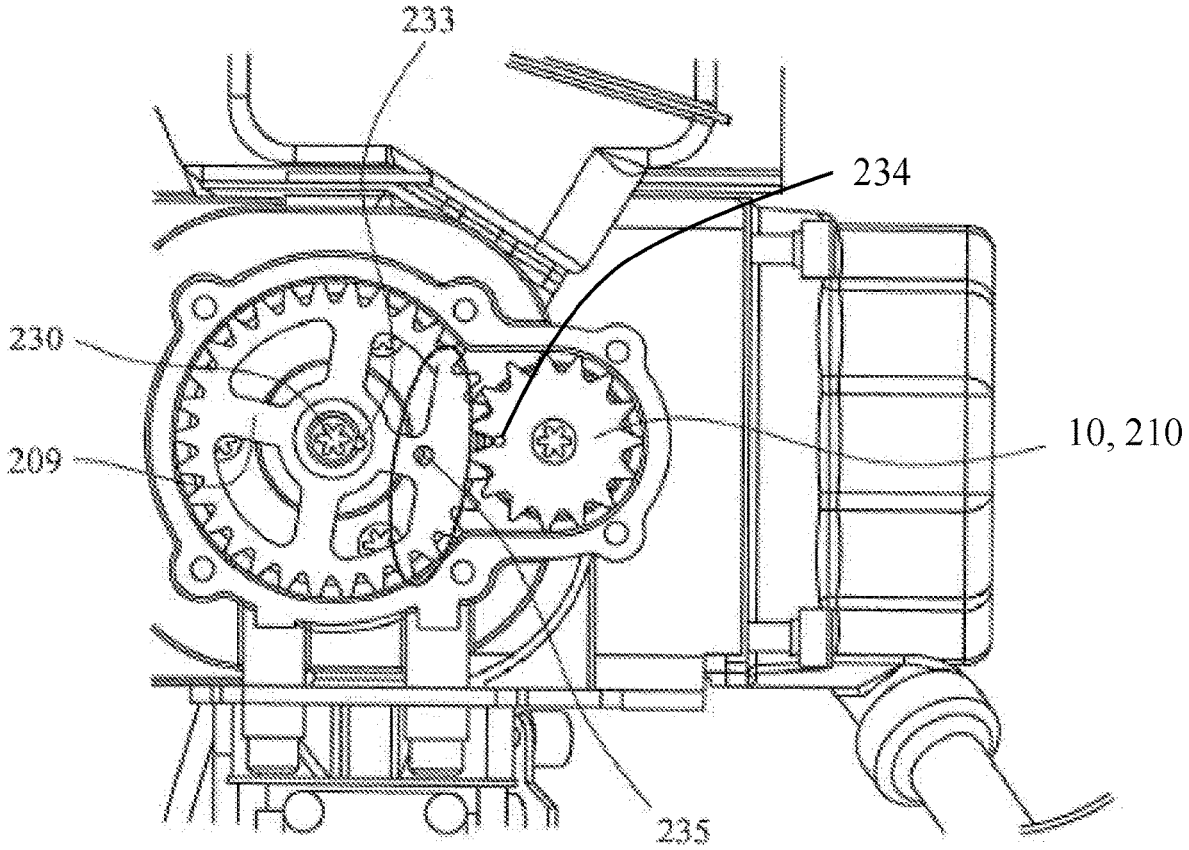
FIG. 9 shows a plan view of the rotary valve drive and driven gears.

Referring further to FIG. 8 and FIG. 9, there is shown the connection between the driven gear 209 and the rotary valve 205. The driven gear 209 is secured coaxially to the rotary valve 205 by means of a counter sunk screw 230. The driven gear 209 has a concentric recess which accommodates the outer end of the shaft 206 and the recess has an annular ring 231 which is aligned with the inner race 228 of the ball bearing 207. A small axial clearance 232 is provided between the annular ring 231 and the inner race 228 to allow a small degree of axial float which means that the valve 205 is not clamped to the inner race 228 and can therefore move slightly radially to accommodate any small concentric offset between the bearing 207 and the valve bore in which the rotary valve rotates.

The correct location of the rotary valve 205 relative to the valve gear, which determines the timing of the engine, is achieved by a timing pin 233. The drive gear 210 has a timing mark 234 which indicates when the engine is at top dead center. The driven gear 209 connected to the rotary valve has a timing hole 235 adapted to receive the timing pin 233 and the driven gear has a corresponding timing hole through which the timing pin is inserted to secure the driven gear 209 to the rotary valve 205 to hold the rotary valve in its top dead center position. The counter sunk screw 230 is then inserted to secure the driven gear 209 to the rotary valve 205 in the correct timing position and the counter sunk head of the screw 230 engages the end of the timing pin 230 to secure this in position. Other means such as a washer on the screw 230 may be used to secure the timing pin 233 in position.

Because the rotary valve has a port 221 cut in its peripheral wall, it is recognized that the mass of the valve is not uniformly disposed about its periphery and this generates out of balance forces as the rotary valve rotates in practice. In a further embodiment of the engine, a counterbalance or counterbalancing mass is created on the valve train, particularly by adding material to the driven gear 209 or by removing material at an appropriate position in the driven gear 209.

The embodiment of FIGS. 7, 8 and 9 shows a rotary valve internal combustion engine comprising: a piston connected to a crankshaft and that reciprocates in a cylinder, the cylinder having a combustion end, a combustion chamber being defined in part by the piston and the combustion end of the cylinder, a valve housing fixed at an outer portion of the combustion end of the cylinder and defining a bore and a rotary valve rotatable about a rotary valve axis in the bore in the valve housing, the rotary valve having a hollow valve body having an interior volume forming a part of the combustion chamber, wherein the interior volume of the hollow valve body is subjected to combustion gases throughout the combustion process, and further having in a wall part thereof a port giving, during rotation of the valve, fluid communication successively to and from the combustion chamber via inlet and exhaust ports in the valve housing, a sealing function being carried out between the surface of the main body of the rotary valve and a contiguous surface of the bore in the valve housing, wherein the rotary valve is mounted in the valve housing for rotation by the crankshaft through a gear drive train, the drive train comprising a drive gear connected to the crankshaft through a bevel drive arrangement, the drive gear being meshed with a driven gear rotatable about the rotary valve axis, the driven gear being rotationally fast with the rotary valve and is located in the correct timing position relative to the rotary valve by a locating pin and is secured to the rotary valve by a securing device which also locks the locating pin in position.

Preferably, the driven gear has an out-of-balance mass to counter-balance an out of balance mass in the rotary valve body.

Figure 10:
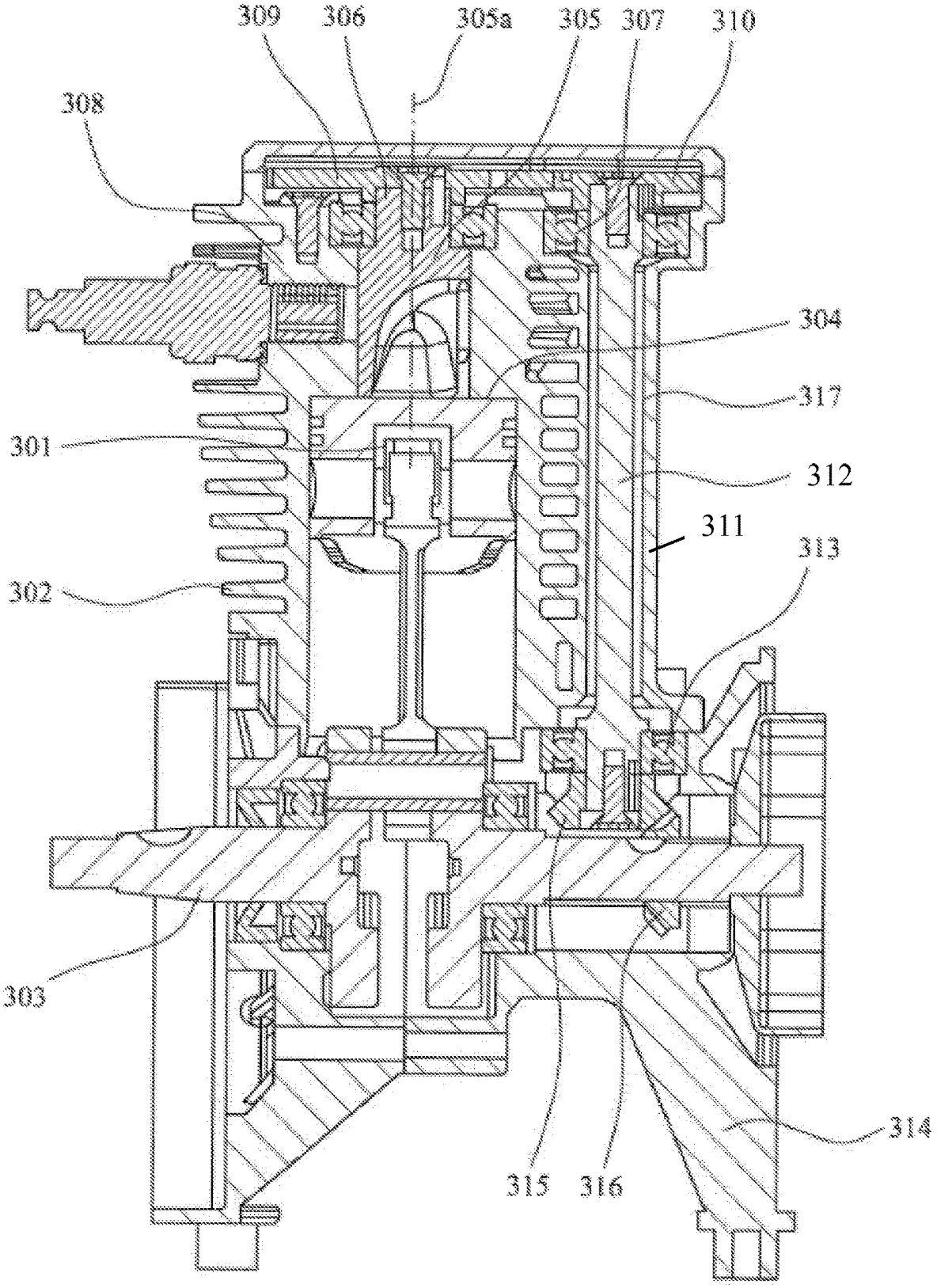
FIG. 10 shows a cross-sectional view of a single cylinder air cooled rotary valve internal combustion engine.

Referring now to FIG. 10, there is shown a single cylinder air cooled engine. The engine has a cylinder housing containing the cylinder 302. A piston 301 is connected in the conventional manner to a crankshaft 303 mounted for rotation in a crankcase 314 for reciprocation in the cylinder 302. The upper part of the cylinder 302 is closed by a combustion chamber 304 in a combustion chamber housing. The flow of inlet air/fuel mix and exhaust gas into and out of the combustion chamber 304 is controlled by a rotary valve 305. In this embodiment, the valve 305 is rotatable in a valve housing 308 in the combustion chamber housing about an axis 305*a* which is co-axial with the axis of the cylinder 302. In other embodiments, the axis of rotation of the valve body is offset from the axis 305*a* of the cylinder 302.

At its end remote from the combustion chamber 304, the rotary valve 305 has a concentric drive shaft 306 carrying a single race ball bearing 307 which rotatably supports the valve 305 in the valve housing 308. The valve driveshaft 306 is secured to a coaxial driven gear 309 which meshes with a drive gear 310 of a drive arrangement 311 through which the driven gear 309 and hence the rotary valve 305 is connected to the crankshaft 303. The drive arrangement 311 includes a drive shaft 312 which is located in a channel or tube 317 formed integrally in the cylinder housing and mounted for rotation in an upper bearing 318 adjacent the drive gear 310 and a lower bearing 313 mounted in the cylinder housing adjacent the crankshaft 303. The channel or tube 317 is formed in the cylinder housing, which may be formed by a casting process. The driveshaft 312 carries a bevel gear 315 which meshes with a corresponding bevel gear 316 secured on the crankshaft for rotation with the crankshaft 303. Thus, the rotation of the crankshaft 303 and hence the piston movement is coordinated with the rotation of the rotary valve 305 so that the engine operates on the conventional four stroke cycle. To achieve this, the diameter of the driven gear 309 is twice that of the drive gear 310 so that the rotary valve 305 rotates at half engine speed.

Figure 11:
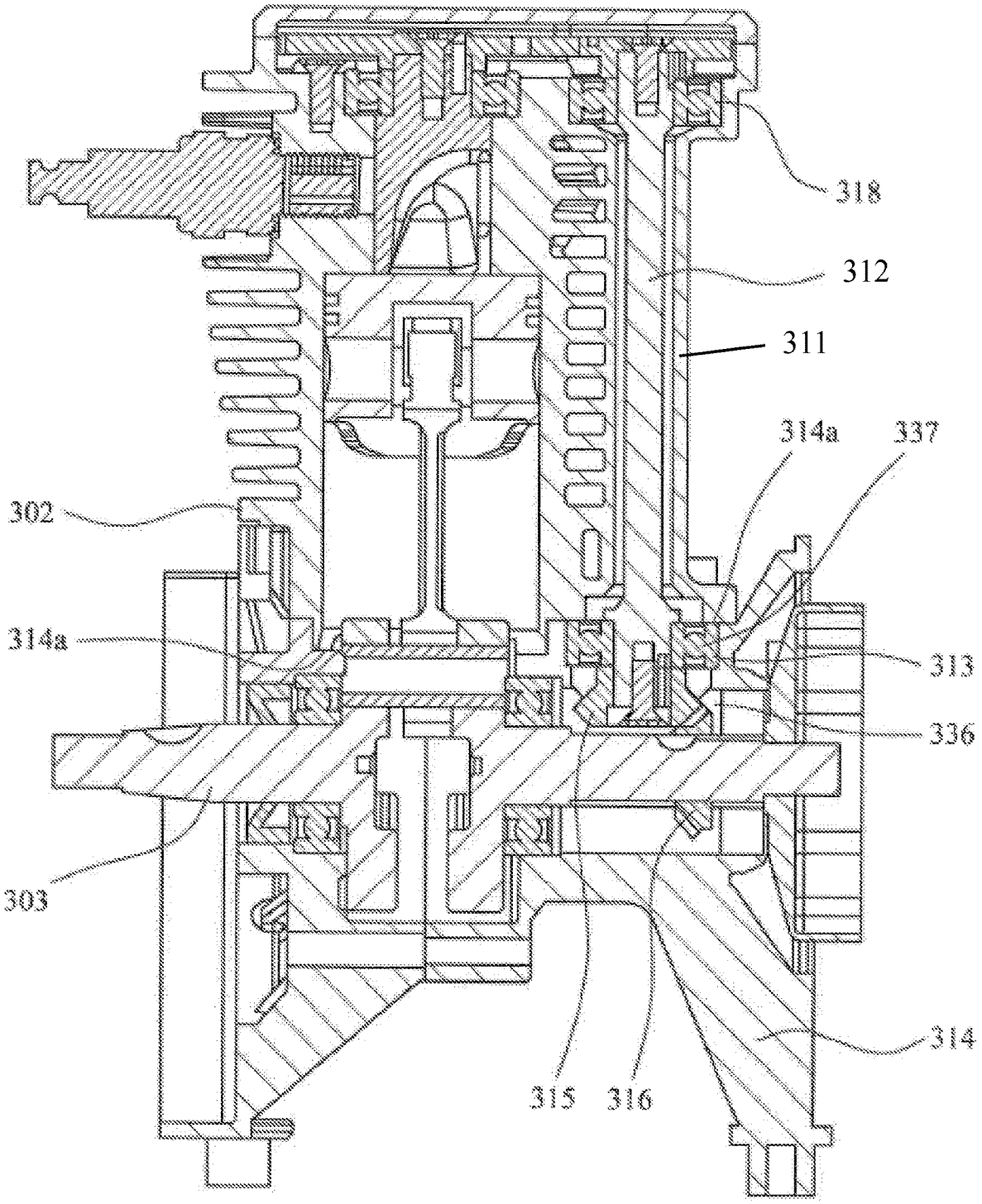
FIG. 11 shows the cross-sectional view of the engine illustrating the dividing line between the cylinder housing and the crankcase.

Referring now to FIG. 11 also, where like references denote like parts, the crankcase 314 has a bore 336 which has a diameter slightly larger than the outer diameter of the bevel gear 315 so that when the cylinder housing carrying the drive arrangement is offered up to the crankcase, the bevel gear 315 can enter the crankcase to mesh with the associated bevel gear 316 which is secured to the crankshaft 314. The upper surface of the crankcase 314 is arranged to mate with the lower surface of the cylinder housing assembly when this is lowered onto the crankcase. The lower bearing 313 is secured in a counter bore 337 formed in the cylinder housing so as to be concentric with the crankcase bore 336 a slight axial clearance is provided between the outer race of the lower bearing 313 and the end of the counter bore 337 within which the bearing sits to ensure that the cylinder housing assembly, including the drive arrangement 311 can mate correctly with the top face 314*a* of the crankcase 314.

In this way, the assembly of the cylinder housing including the rotary valve 305 and the main part of the drive gear arrangement 311 is formed as a sub assembly for mating with the crankcase 314. For final assembly, the piston which is carried by the crankcase 314 is fed into the piston bore in the cylinder housing 302 and at the same time the bevel gear 315 is fed through the crankcase bore 336 to complete the engine assembly.

The embodiment of FIGS. 10 and 11 shows a rotary valve internal combustion engine comprising: a crankcase containing a crankshaft, a piston being connected to the crankshaft and reciprocatable in a cylinder in a cylinder housing connected to the crankcase, the cylinder having a combustion end, a combustion chamber being defined in part by the piston and the combustion end of the cylinder, a valve housing at an outer portion of the combustion end of the cylinder and defining a bore and a rotary valve rotatable about a rotary valve axis in the bore in the valve housing, the rotary valve having a hollow valve body having an interior volume forming a part of the combustion chamber, wherein the interior volume of the hollow valve body is subjected to combustion gases throughout the combustion process, and further having in a wall part thereof a port giving, during rotation of the valve, fluid communication successively to and from the combustion chamber via inlet and exhaust ports in the valve housing, wherein the rotary valve is mounted on a bearing secured in the valve housing for rotation by the crankshaft through a gear drive train, the drive train comprising a drive gear connected to the crankshaft through a bevel drive arrangement, the drive gear being meshed with a driven gear rotatable about the rotary valve axis, the driven gear being secured for rotation with the rotary valve, the bevel drive arrangement comprising a bevel gear rotationally fast on the crankshaft meshed with a bevel gear secured at one end of a drive shaft mounted for rotation in the cylinder housing, the drive shaft carrying the drive gear on its end opposite the bevel gear, wherein a mating surface of the cylinder housing is adapted to mate with a corresponding surface on the crankcase, the crankcase incorporating an opening through which, on assembly, the bevel gear on the driveshaft enters the crankcase to engage with the bevel gear on the crankshaft.

In this embodiment the drive shaft maybe located in a passage formed in the cylinder housing, and the drive shaft maybe located rotationally in bearings mounted in the cylinder housing.

Figure 12:
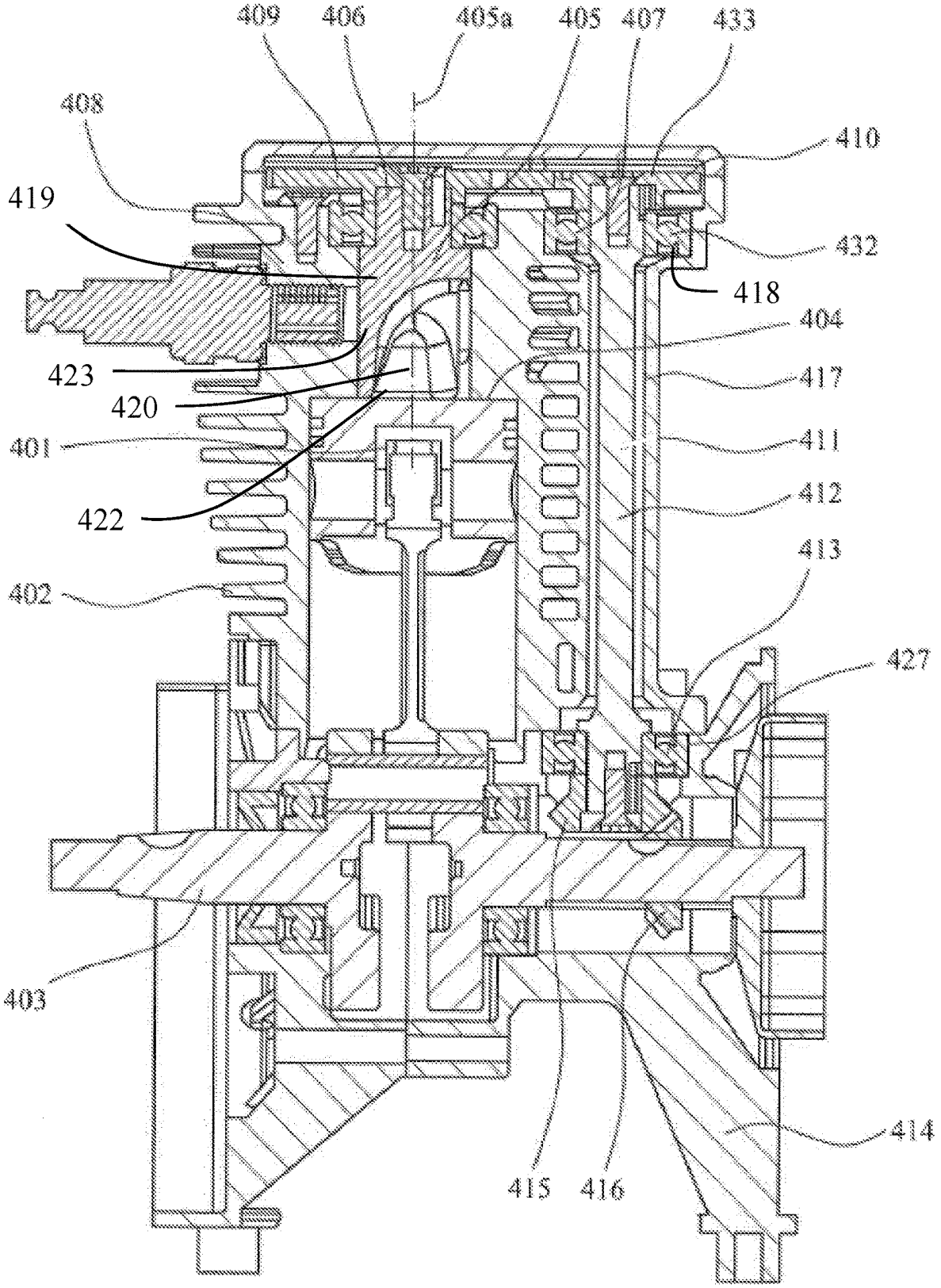
FIG. 12 shows a cross-sectional view of a single cylinder air cooled rotary valve internal combustion engine.

Referring now to FIG. 12, there is shown a single cylinder air cooled engine. The engine has a cylinder housing containing the cylinder 402. A piston 401 is connected in the conventional manner to a crankshaft 403 mounted for rotation in a crankcase 414 for reciprocation in the cylinder 402.

The upper part of the cylinder 402 is closed by a combustion chamber 404 in a combustion chamber housing. The flow of inlet air/fuel mix and exhaust gas into and out of the combustion chamber 404 is controlled by a rotary valve 405. In this embodiment, the valve 405 is rotatable in a valve housing 408 in the combustion chamber housing about an axis 405*a* which is co-axial with the axis of the cylinder 402. In other embodiments, the axis of rotation of the valve body is offset from the axis 405*a* of the cylinder 402.

At its end remote from the combustion chamber 404, the rotary valve 405 has a concentric drive shaft 406 carrying a single race ball bearing 407 which rotatably supports the valve 405 in the valve housing 408. The valve driveshaft 406 is secured to a coaxial driven gear 409 which meshes with a drive gear 410 of a drive arrangement 411 through which the driven gear 409 and hence the rotary valve 405 is connected to the crankshaft 403. The drive arrangement 411 includes a drive shaft 412 which is located in a channel or tube 417 in the cylinder housing and mounted for rotation in an upper bearing 418 adjacent the drive gear 410 and a lower bearing 413 adjacent the crankshaft 403. The channel or tube 417 is cast into the cylinder housing. The channel or tube 417 is formed integrally with the cylinder housing, which may be formed by a casting process. The driveshaft 411 carries a bevel gear 415 which meshes with a corresponding bevel gear 416 secured on the crankshaft for rotation with the crankshaft 403. Thus, the rotation of the crankshaft 403 and hence the piston movement is coordinated with the rotation of the rotary valve 405 so that the engine operates on the conventional four stroke cycle. To achieve this, the diameter of the driven gear 409 is twice that of the drive gear 410 so that the rotary valve 405 rotates at half engine speed.

Figure 14:
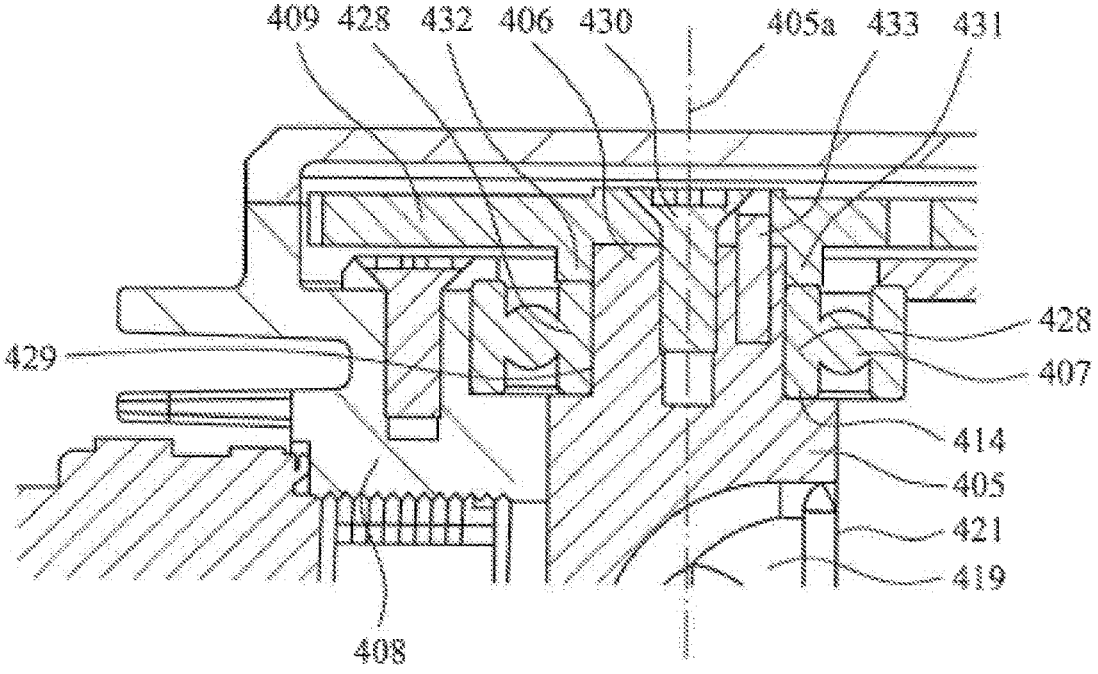
FIG. 14 shows a plan view of the rotary valve drive and driven gears.
Figure 15:
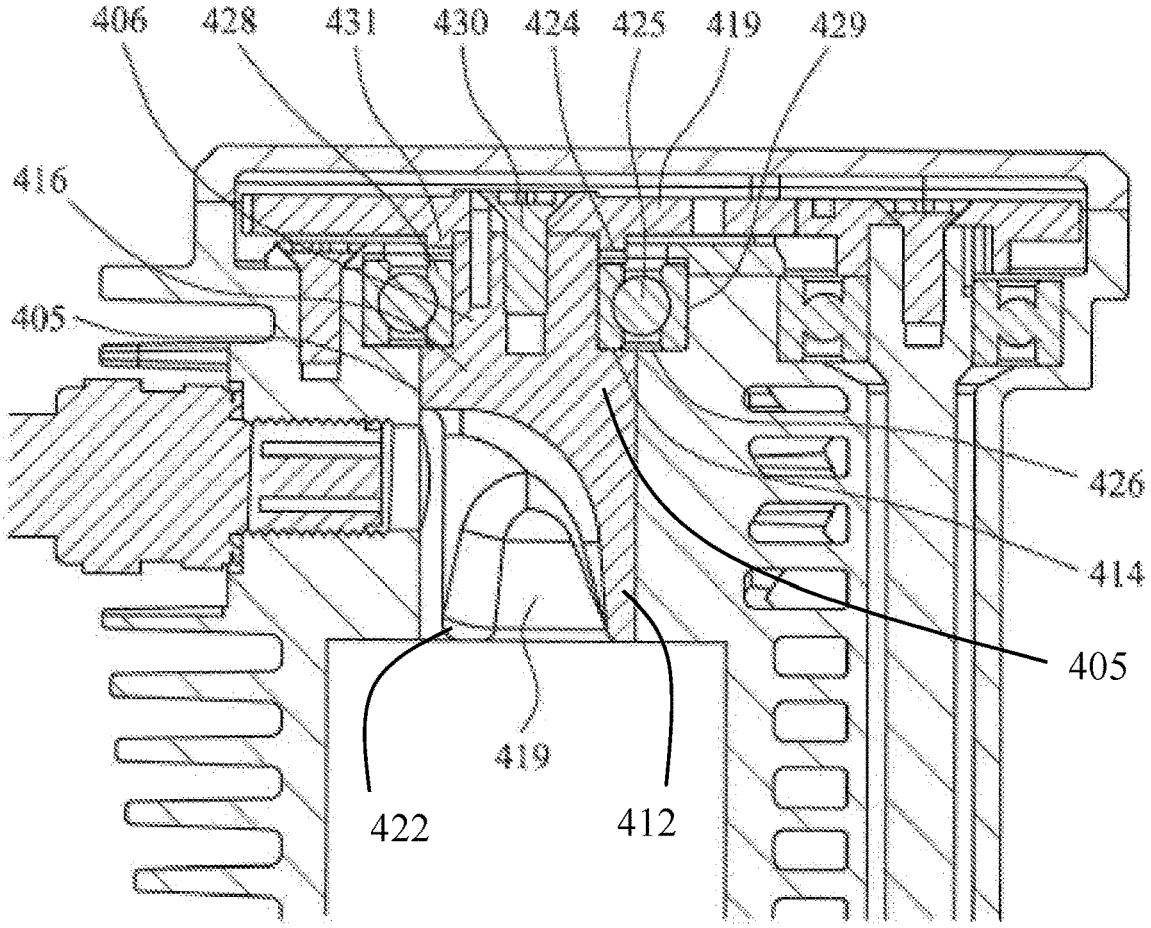
FIG. 15 shows an enlarged sectional view of the rotary valve and drive gear.

Referring additionally to FIGS. 14 and 15, there is shown more detail of the rotary valve 405 which comprises a generally cylindrical rotary valve body 405 rotatable about a rotary valve axis 405*a* with a close sliding fit in the bore in the valve housing 408, the rotary valve 405 having a hollow valve body 419 having an interior volume 420 forming a part of the combustion chamber. The valve has a generally cylindrical body part comprising the valve body 419 itself which is slightly larger in diameter than the shaft 406, which forms a shoulder 414 against which the inner race 428 of the ball bearing 407 is located. The valve body 419 extends into the combustion chamber and has in its interior a volume 420 which forms part of the combustion chamber 404 and which is subject to combustion gases at all stages of the combustion process. The valve body 419 is rotatable in a bore in a valve housing 408 with a close sliding fit. The valve 405 and the valve housing 8 are formed of aluminum.

The shaft 406 part of the rotary valve 405 is only slightly smaller in diameter than the valve body 419 to provide the shoulder 414. The shaft is solid to provide a good path for conducting heat from the valve body 416 to the exterior The rotary valve body port 421, during rotation of the valve, enables fluid communication successively to and from the interior volume of the valve and hence the combustion chamber via inlet and exhaust ports in the valve housing. In this embodiment the port 421 is in the form of a recess formed in the lower peripheral edge 422 of the wall 423 of the valve body adjacent to the combustion chamber 404 the recess extending upwardly from this lower edge of the wall of the valve to form the port 421 in the side of the valve.

Figure 13:
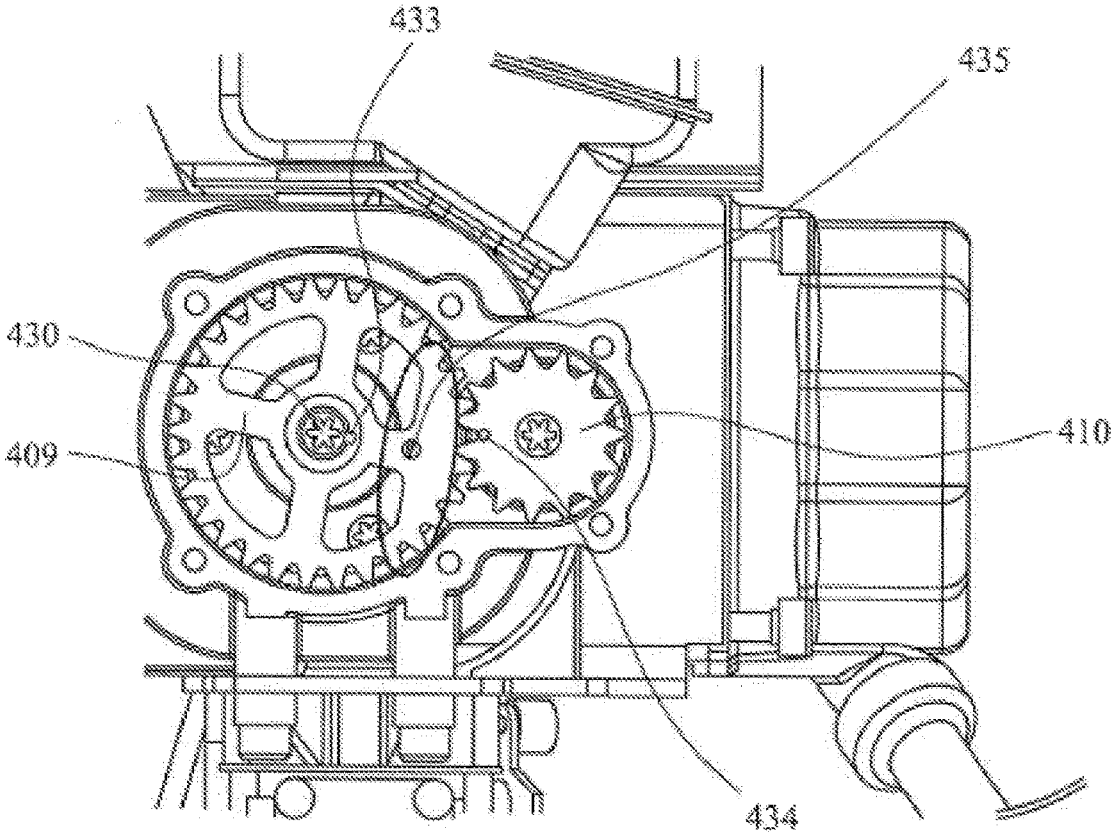
FIG. 13 is an enlarged schematic view of part of the rotary valve body and drive gear.

Referring further to FIG. 13 and FIG. 14, there is shown the connection between the driven gear 409 and the rotary valve 405. The driven gear 409 is secured coaxially to the rotary valve 405 by means of a countersunk screw 430. The driven gear 409 has a concentric recess which accommodates the outer end of the shaft 406 and the recess has an annular rib 431 which is aligned with the inner race 428 of the ball bearing 407. An axial clearance 432 is provided between the annular ring 431 and the inner race 428 to allow a small degree of axial float which means that the valve 405 is not clamped to the inner race 428 and can therefore move slightly radially to accommodate any small concentric offset between the bearing 407 and the valve bore in which the rotary valve rotates.

In operation, the forces generated by the combustion gases tend to move the valve body axially relative to the valve housing. To prevent hammering of the shoulder 414 against the inner race 428 of the bearing 407 caused by axial movement of the valve body 416 relative to the inner race 428 of the bearing, which would otherwise occur during every combustion cycle, a resilient element in the form of a wave spring 424 biases driven gear 409 to urge the shoulder 414 of the valve body 416 upwards into contact with the lower face of the inner race 428, as shown in FIG. 15, with a sufficient force to prevent hammering or chattering between the two components during operation but not too powerful to prevent the slight radial movement of the valve body necessary to accommodate slight misalignment between the valve and the valve housing which will occur in practice as a result of slight differences caused by manufacturing tolerances of the components.

Figure 16A:
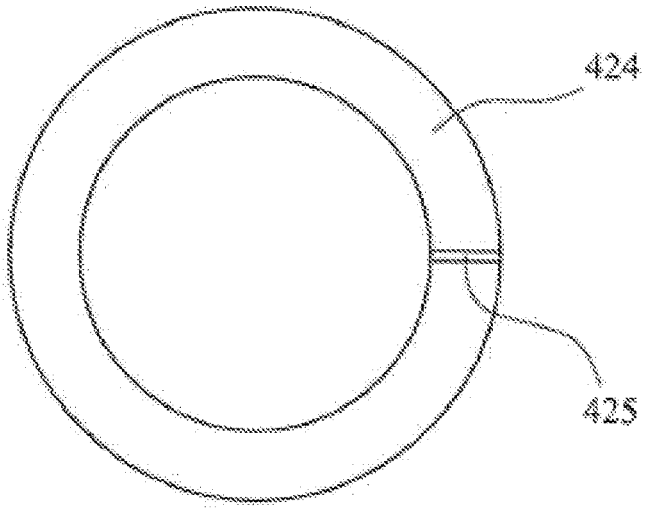
FIGS. 16*a*-16*b* show, respectively, plan and side views of a wave spring.
Figure 16B:
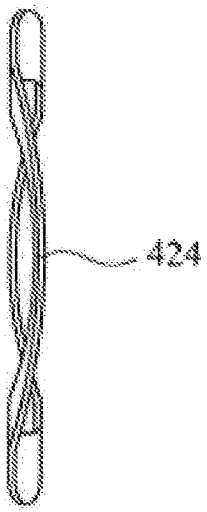

As shown in FIGS. 16*a*-16*b*, the wave spring consists of a generally annular plate-like body. Throughout its annular length, the wave spring 424 has a plurality of wave forms curving the spring out of a radial plane as shown particularly in FIGS. 5*b* and 5*c*. In this embodiment the wave spring is formed out of a spring steel. The spring element could be formed of other materials, designs or profiles, providing they meet the objective of being able to provide the resilient damping effect required and being able to cope with the harsh environmental conditions in the engine.

Figure 17:
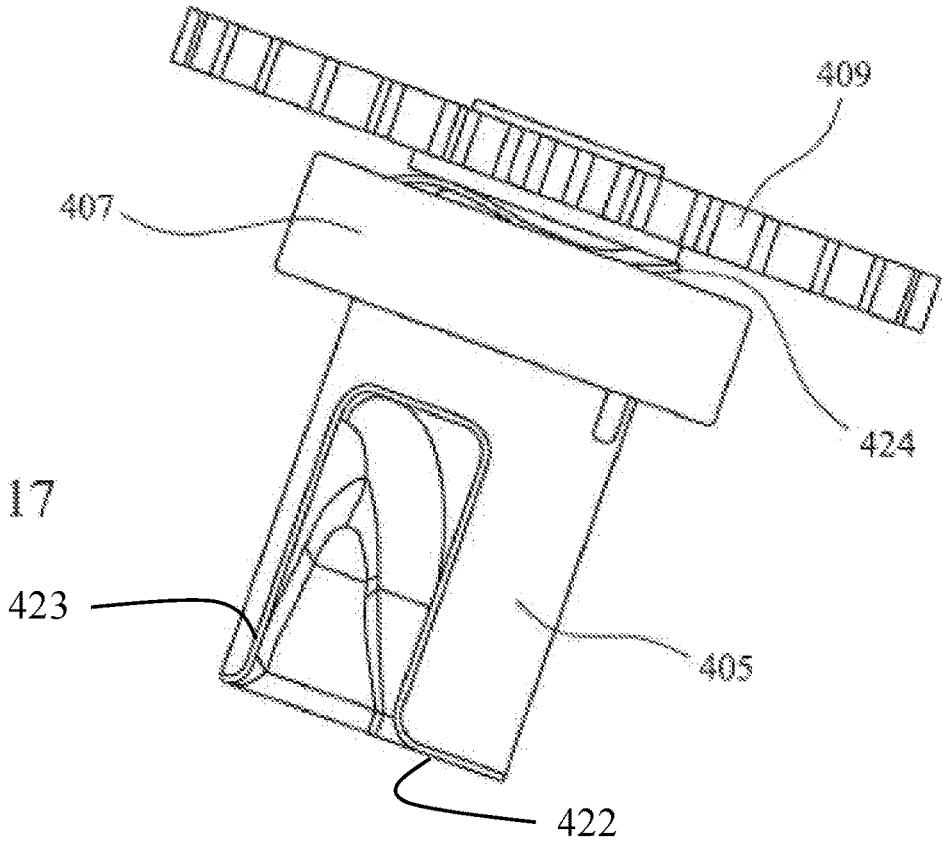
FIG. 17 shows a view of the valve and a driven gear.
Figure 18:
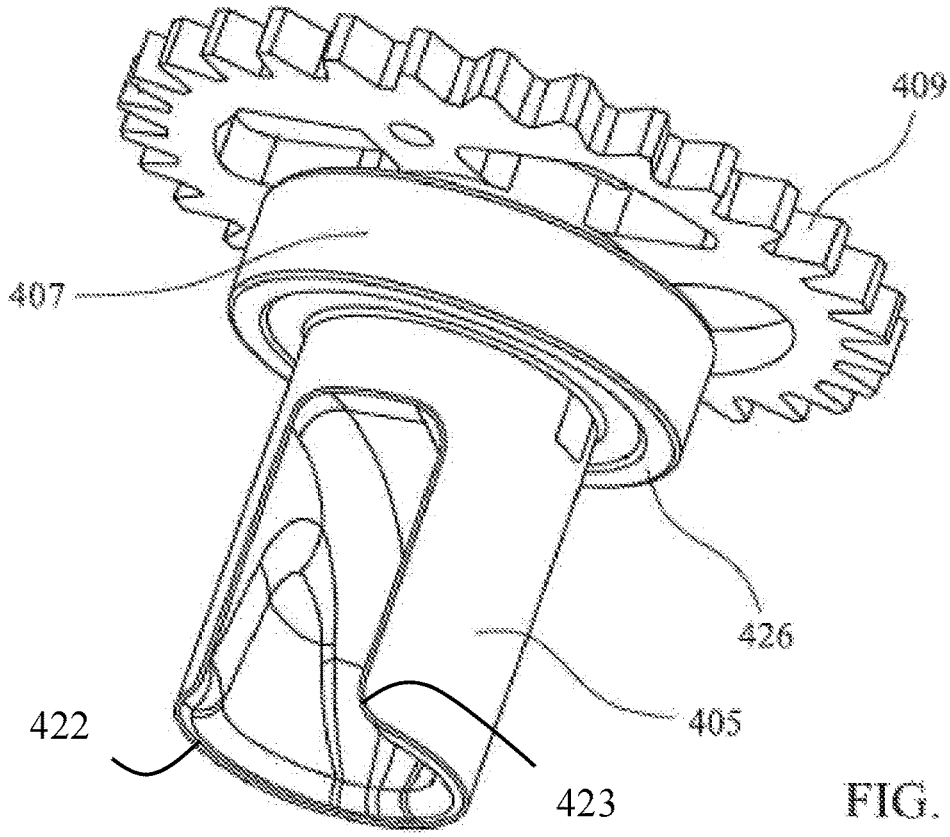
FIG. 18 shows a view of the valve and a ball bearing.

FIG. 17 illustrates a schematic perspective view of the rotary valve 405 and the driven gear 409 with the wave spring 424 in position between the inner race 428 of the bearing and the driven gear 409. FIG. 18 illustrates a similar schematic perspective view of the rotary valve 405 and the driven gear 409 with the single race ball bearing 407 in position. As shown also in FIG. 19, the space between the inner and outer races 428 and 429 of the bearing 407 is closed at its lower edge by a metal seal 426.

It has been found that in practice some combustion gases escape between the interface between the rotary valve body 405 and the valve housing 408. These waste combustion gases can pass through the bearing 407 past the balls 425 and into the chamber containing the driven gear and the wave spring causing a buildup of carbon which adversely affects the performance and durability of the valve and the high temperature and corrosive action of the hot gases can cause premature failure of the wave spring. To prevent, or at least minimize, the combustion gases leaking across the bearing 407, the seal 426 closes the gap between the inner and outer races 428 and 429 of the bearing. The seal is formed of a metal to cope with the harsh environmental conditions. Furthermore, the seal limits the escaping combustion gases from damaging or destroying the resilient spring.

Figure 19:
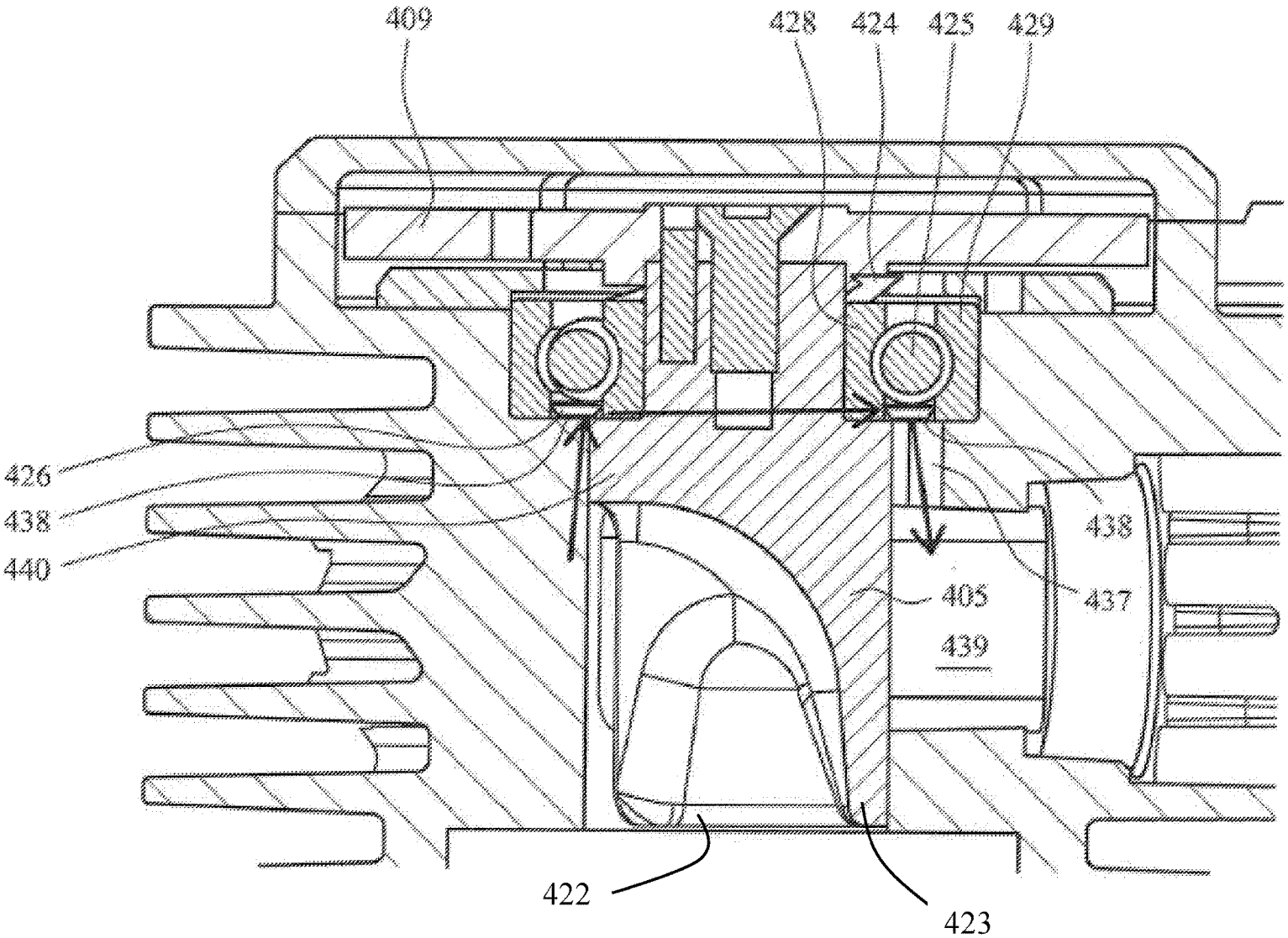
FIG. 19 shows the path of escaping combustion gases.

Referring now to FIG. 19 there is shown an enlarged view of the valve and bearing arrangement illustrating an improvement in which a vent passage 437 is provided from the narrow annular space 428 between the annular metal seal 426 and the valve housing leading into the inlet port as illustrated by the black arrows 440. This has the advantage that the escaping combustion gases are fed back into the inlet port 439 where they are recycled through the engine to improve the engine emissions performance.

Because the rotary valve has a port 421 cut in its peripheral wall, it is recognized that the mass of the valve is not uniformly disposed about its periphery and this generates out of balance forces as the rotary valve rotates in practice. In a further embodiment of the engine, a counterbalance or counterbalancing mass is created on the valve train, particularly by adding material to the driven gear 409 or by removing material at an appropriate position in the driven gear 409. The embodiment described is a single cylinder air cooled engine but it will be understood that the invention is equally applicable to multicylinder and/or watercooled engines.

The embodiment of FIGS. 12 to 19 show a rotary valve internal combustion engine comprising: a piston connected to a crankshaft and that reciprocates in a cylinder, the cylinder having a combustion end, a combustion chamber being defined in part by the piston and the combustion end of the cylinder, a valve housing fixed at an outer portion of the combustion end of the cylinder and defining a bore and a rotary valve rotatable about a rotary valve axis in the bore in the valve housing, the rotary valve having a hollow valve body having an interior volume forming a part of the combustion chamber, wherein the interior volume of the hollow valve body is subjected to combustion gases throughout the combustion process, and further having in a wall part thereof a port giving, during rotation of the valve, fluid communication successively to and from the combustion chamber via inlet and exhaust ports in the valve housing, a sealing function being carried out between the surface of the main body of the rotary valve and a contiguous surface of the bore in the valve housing, wherein the rotary valve is mounted in the valve housing for rotation by the crankshaft through a gear drive train, the drive train including a driven gear rotatable about the rotary valve axis, the driven gear being rotationally fast with the rotary valve, a bearing being provided between the driven gear and the valve body, the bearing comprising a single bearing, wherein the space between the inner and outer races of the bearing is closed by a seal to substantially limit combustion gases passing through the bearing.

Preferably, the seal is on the valve side of the single race ball bearing thereby shielding the ball bearing from the combustion gases, and the seal maybe formed of metal.

In a further development, a vent passage maybe provided to vent combustion gases from between the space between the valve body and the valve housing back into the inlet port, the vent consisting of either a drilled bore or a groove in the valve bore face.

In a further development as an embodiment, a predetermined axial gap Is provided between the driven gear and the bearing in which the rotary valve is mounted, and the driven gear has an annular rib aligned with the inner race of the bearing, the axial gap being formed between the annular rib and the inner race of the bearing.

In this embodiment, the seal preferably comprises a resilient annular element, being co-axial with the rotary valve and may be a wave spring.

It is to be understood that the features of the various embodiments described herein may be combined with each other, unless specifically noted.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptions or variations of the specific embodiments discussed herein. Therefore, it is intended that this invention be limited only by the claims and the equivalents thereof.

The invention claimed is:

1. A rotary valve internal combustion engine adapted for use in a hand-held machine, comprising:

a piston connected to a crankshaft and being reciprocatable in a cylinder, the cylinder having a combustion end, a combustion chamber being defined in part by the piston and the combustion end of the cylinder, a valve housing being fixed at an outer portion of the combustion end of the cylinder and defining a bore, a rotary valve rotatable about a rotary valve axis in the bore, the rotary valve having a hollow valve body having an interior volume forming a part of the combustion chamber, wherein the interior volume of the hollow valve body is subjected to combustion gases throughout the combustion process, in a wall part of the rotary valve, a port giving, during rotation of the rotary valve, fluid communication successively to and from the combustion chamber via inlet and exhaust ports in the valve housing, a carburetor for controlling the air/fuel mix into the combustion chamber, an exhaust muffler for exhausting exhaust gases from the combustion chamber, wherein the inlet and exhaust ports are arranged such that a main body of the carburetor and a main body of the exhaust muffler are on opposite sides of the engine and substantially parallel to a centerline of the crankshaft, wherein, when the piston is at top dead center, the inlet port is angled by a first predetermined number of degrees towards the carburetor to reduce a radial offset of the inlet port, thereby causing a mounting flange for the carburetor to be substantially parallel to the centerline of the engine, wherein the centerline of the inlet port is offset, by a first angular offset, towards the carburetor by a second predetermined number of degrees from a radial line from the cylinder axis, the first angular offset allowing the mounting flange for the carburetor to be substantially parallel to the centerline of the engine, and wherein the centerline of the exhaust port is offset, by a second angular offset, towards the exhaust muffler by a third predetermined number of degrees from the radial line from the cylinder axis, the second angular offset allowing the main body of the exhaust muffler to be substantially parallel to the centerline of the engine using an angled mounting flange.

2. The rotary valve internal combustion engine according to claim 1, wherein the first angular offset is smaller than the second angular offset.

3. The rotary valve internal combustion engine according to claim 1, wherein the angled mounting flange mates with a corresponding mounting of the exhaust port so that the main body of the exhaust muffler is aligned substantially with the centerline of the engine.

4. The rotary valve internal combustion engine according to claim 1, further comprising an air guide panel that guides inlet cooling air around the cylinder towards a rear face of the cylinder.

5. The rotary valve internal combustion engine according to claim 1, further comprising a closure plate at a rear of the engine that forces inlet cooling air to exit from a rear of a cowl rather than short circuiting down into a cooling air intake.

6. The rotary valve internal combustion engine according to claim 1, further comprising an airbox containing a curved tuning pipe leading from an air inlet of the engine into a filtered air volume part of the airbox.

7. The rotary valve internal combustion engine according to claim 6, wherein the curved tuning pipe is secured to an air inlet of the carburetor.

8. The rotary valve internal combustion engine according to claim 6, wherein the airbox is divided into an unfiltered volume and filtered volume by a dividing wall, the dividing wall containing a filter through which air passes from the unfiltered volume to the filtered volume, a tuning pipe air inlet being located in the filtered volume.

9. The rotary valve internal combustion engine according to claim 8, wherein the curved tuning pipe passes from the carburetor through the unfiltered volume and through the dividing wall into the filtered volume.

10. The rotary valve internal combustion engine according to claim 8, wherein the curved tuning pipe passes through the filter in the dividing wall.

11. The rotary valve internal combustion engine according to claim 6, wherein the curved tuning pipe has a serpentine profile.

12. A manually held horticultural machine having an engine as claimed in claim 1.

* * * * *